US006539904B2

(12) United States Patent
Ito et al.

(10) Patent No.: US 6,539,904 B2
(45) Date of Patent: Apr. 1, 2003

(54) VALVE-OPERATING MECHANISM IN 4-CYCLE ENGINE

(75) Inventors: Keita Ito, Wako (JP); Takao Nishida, Wako (JP); Takeshi Maeda, Wako (JP); Yasuhiro Shimizu, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/946,956

(22) Filed: Sep. 6, 2001

(65) Prior Publication Data

US 2002/0033153 A1 Mar. 21, 2002

(30) Foreign Application Priority Data

Sep. 12, 2000 (JP) ..... 2000-276459
Oct. 30, 2000 (JP) ..... 2000-329934

(51) Int. Cl.[7] ..... F01L 1/02
(52) U.S. Cl. ..... 123/90.31; 123/90.27; 123/90.44; 123/90.38
(58) Field of Search ..... 123/90.31, 90.39, 123/90.41, 90.44, 90.27, 90.38, 196 R, 90.23; 184/6.2, 11.1

(56) References Cited

U.S. PATENT DOCUMENTS 5,460,130 A * 10/1995 Fukuzawa et al. ..... 123/90.16
5,706,769 A 1/1998 Shimizu ..... 123/90.23
5,960,764 A * 10/1999 Araki ..... 123/196 CP

FOREIGN PATENT DOCUMENTS

| | | |
|---|---|---|
| EP | 0 839 992 A1 | 5/1998 |
| EP | 1 039 099 A1 | 9/2000 |
| FR | 2 773 589 A1 | 7/1999 |
| JP | 2000-161074 | 6/2000 |

* cited by examiner

*Primary Examiner*—Thomas Denion
*Assistant Examiner*—Jaime Corrigan
(74) *Attorney, Agent, or Firm*—Armstrong, Westerman & Hattori, LLP

(57) ABSTRACT

In a valve-operating mechanism in a 4-cycle engine, a timing transmitting device is disposed on one side of an engine body. A cam device includes a cam coupled to a driven pulley of the timing transmitting device on one side of a cylinder head, intake and exhaust rocker shafts rotatably carried in the cylinder head, intake and exhaust cam followers secured to one ends of the rocker shafts with their tip ends in sliding contact with the cam, and intake and exhaust rocker arms secured to the other ends of the intake and exhaust rocker shafts with their tip ends abutting against the intake and exhaust valves. Thus, the cam of the cam device can be disposed on one side of the cylinder head to effectively reduce the entire height of the engine.

4 Claims, 14 Drawing Sheets

UPSIDE- DOWN STATE

LAID-SIDEWAYS TATE

VALVE-OPERATING MECHANISM IN 4-CYCLE ENGINE

BACKGROUND OF THE INVENTION

1. Field of the Invention

The present invention relates to a valve-operating mechanism in a 4-cycle engine and, more particularly, to an improvement in a valve-operating mechanism comprising a timing transmitting device having a driving rotary member connected to a crankshaft, and a cam device for transmitting a rotational force of a driven rotary member of the timing transmitting device as an opening/closing force to intake and exhaust valves mounted in a cylinder head.

2. Description of the Related Art

Such a valve-operating mechanism in a 4-cycle engine is already known, for example, as disclosed in Japanese Patent Application Laid-open No. 2000-161074.

As disclosed in the above Patent Publication, the cam device of the valve-operating mechanism is of a structure in which a cam having a relatively large diameter is obliged to be disposed immediately above the cylinder head, whereby the entire height of the engine is increased, which obstructs the compactness of the engine.

SUMMARY OF THE INVENTION

Accordingly, it is an object of the present invention to provide a valve-operating mechanism of the above-described type in a 4-cycle engine, wherein a cam of a cam device can be disposed on one side of c cylinder head, thereby reducing the entire height of the engine to contribute to the compactness of the engine.

To achieve the above object, according to a fist aspect and feature of the present invention, there is provided a valve-operating mechanism in a 4-cycle engine, comprising a timing transmitting device having a driving rotary member connected to a crankshaft, and a cam device for transmitting a rotational force of the driven rotary member of the timing transmitting device as an opening/closing force to intake and exhaust valves mounted in a cylinder head, wherein the timing transmitting device is disposed on one side of an engine body, and the cam device comprises a cam coupled to the driven rotary member of the timing transmitting device on one side of the cylinder head, intake and exhaust rocker shafts rotatably carried in the cylinder head, intake and exhaust cam followers secured to one ends of the rocker shafts with their tip ends in sliding contact with the cam, and intake and exhaust rocker arms secured to the other ends of the intake and exhaust rocker shafts with their tip ends abutting against the intake and exhaust valves.

The driving rotary shaft corresponds to a driving pulley 23 in an embodiment of the present invention, which will be described hereinafter, and the driven rotary member corresponds to a driven pulley 24.

With the first feature, the cam having a relatively large diameter is disposed on one side of the cylinder head, and the intake and exhaust rocker arms and the intake and exhaust rocker shafts having a relatively small diameter are disposed immediately above the cylinder head. Therefore, the valve-operating mechanism cannot be bulky above the cylinder head to contribute to a reduction in entire height of the engine an in its turn, to the compactness of the engine.

According to a second aspect and feature of the present invention, in addition to the first feature, a belt guide tube is integrally connected to the cylinder head with its upper end opened and accommodates the timing transmitting device; a head cover is coupled to the cylinder head and the belt guide tube to cover the timing transmitting device and the cam device from the above; and a support shaft supporting the driven rotary member and the cam and the rocker shafts are disposed above the coupled portions of the cylinder head, the belt guide tube and the head cover.

The coupled portions correspond to seal beads 87 in the embodiment of the present invention, which will be described hereinafter.

With the second feature, in a state in which the head cover has been removed, the support shaft and the intake and exhaust rocker shafts can be assembled and disassembled above the coupled portions of the belt guide tube and the cylinder head without being obstructed by the cylinder head and the coupled portions of the belt guide tube and the cylinder head, leading to improved assemblability and maintenance.

According to a third aspect and feature of the present invention, in addition to the first feature, the cam is rotatably carried at an intermediate portion of the support shaft rotatably supported at its opposite ends on the engine body.

With the third feature, the cam and the support shaft are capable of being rotated individually and freely. Therefore, during rotation of the cam caused by the timing transmitting device, the support shaft is also rotated in such a manner that it is dragged by the friction, whereby a difference between the rotational speeds of the cam and the support shaft can be reduced to reduce the wearing of rotational sliding portions. This can contribute to an enhancement in durability of the cam and the support shaft without use of a special material and surface treatment.

According to a fourth aspect and feature of the present invention, in addition to the third feature, the driven rotary member which is a driven pulley of the timing transmitting device is formed integrally on the cam and carried on the support shaft along with the cam, and the timing transmitting device is mounted to face the inside of an oil tank storing a lubricating oil and accommodating oil slingers for scattering the oil.

With the fourth feature, the oil scattered within the oil tank by the oil slingers can be sprinkled over a portion of the timing transmitting device and transferred to the entire timing transmitting device and the cam with the operation of the timing transmitting device to lubricate the timing transmitting device and the cam.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings.

Figure 1:
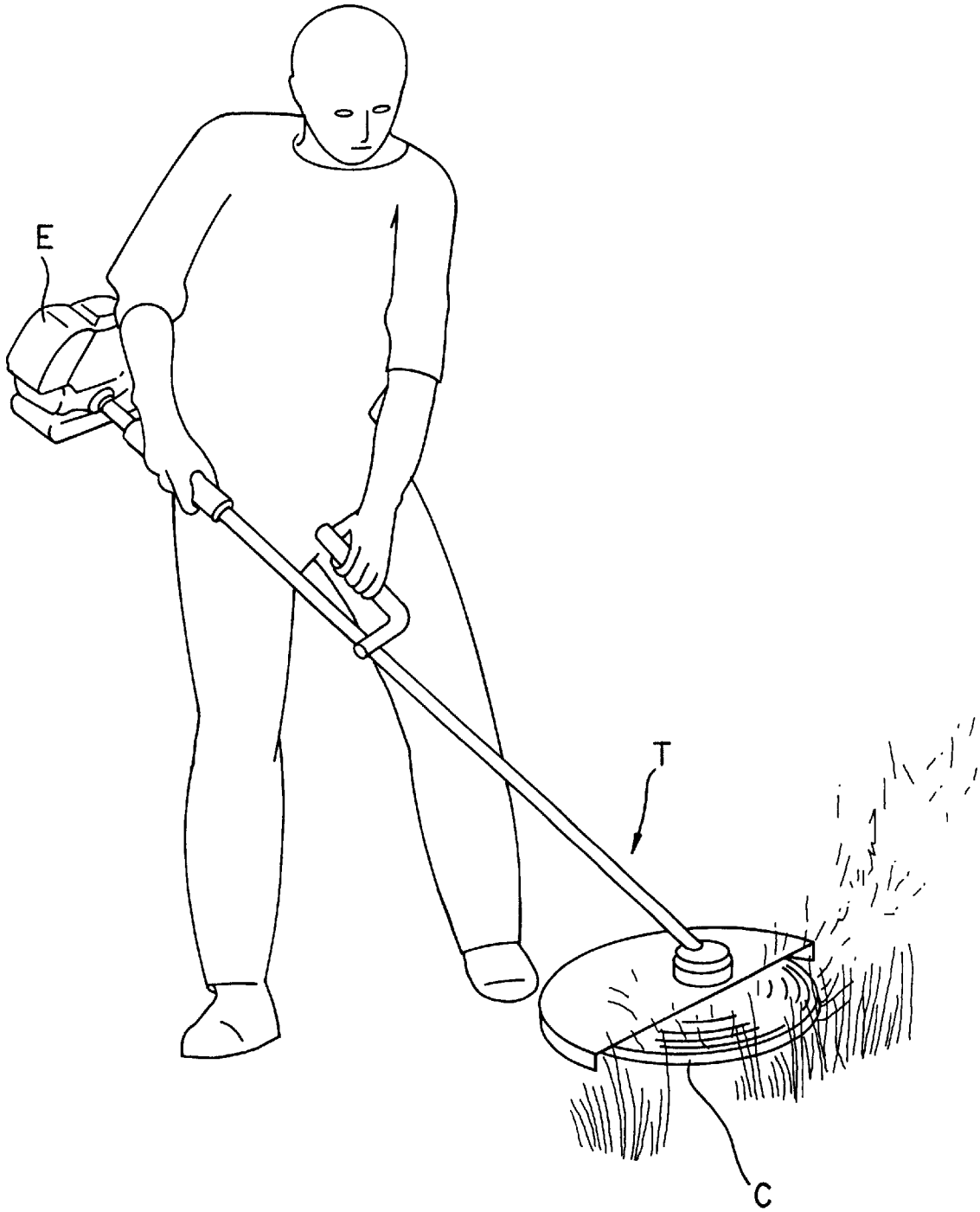
FIG. 1 is a perspective view of an application example of hand-held type 4-cycle engine according to the present invention.

As shown in FIG. 1, a hand-held type 4-cycle engine E is attached as a power source, for example, for a power trimmer T, to the power trimmer T. The power trimmer T is used with its cutter C turned in any of various directions depending on a working state thereof, and hence, in each case, the engine E is also inclined to a large extent, or turned upside down. Therefore, the operational attitude of the power trimmer T is variable.

Figure 2:
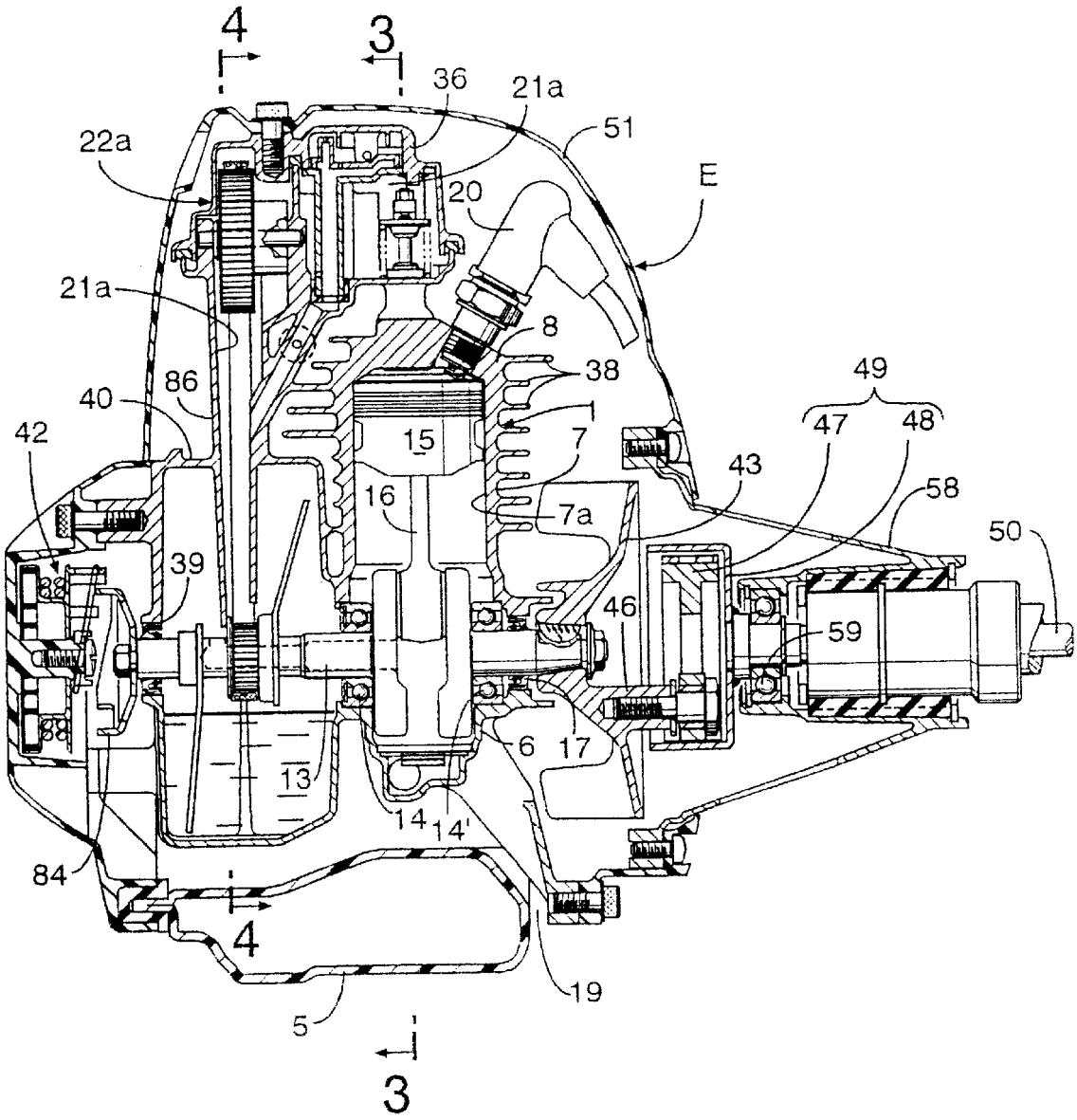
FIG. 2 is a vertical sectional view of the 4-cycle engine.
Figure 3:
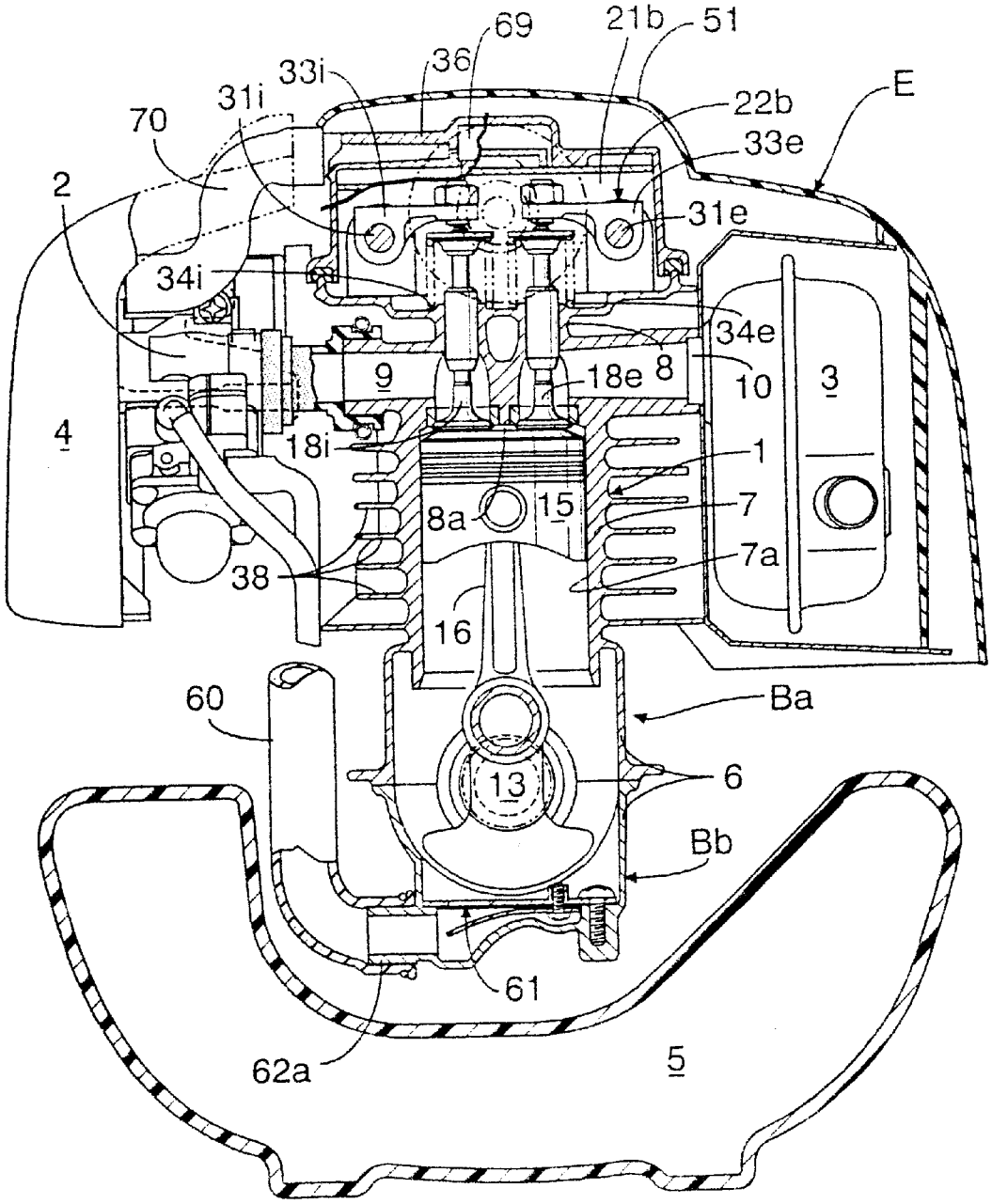
FIG. 3 is a sectional view taken along a line 3—3 in FIG. 2.

First, the arrangement around an outer periphery of the hand-held type 4-cycle engine E will be described with reference to FIGS. 2 and 3.

A carburetor 2 and an exhaust muffler 3 are mounted at front and rear locations on an engine body 1 of the hand-held type 4-cycle engine E, respectively, and an air cleaner 4 is mounted at an inlet of an intake passage of the carburetor 2. A fuel tank 5 made of a synthetic resin is mounted to a lower surface of the engine body 1. A crankshaft 13 has opposite ends protruding sideways from the engine body 1 and an oil tank 40 adjoining one side of the engine body 1, respectively, and a recoiled starter 42 is mounted to an outer side of the oil tank 40 and is capable of being operatively connected to a driven member 84 secured to one end of the crankshaft 13.

A cooling fan 43 also serving as a flywheel is secured to the other end of the crankshaft 13. The cooling fan 43 has a plurality of mounting bosses 46 (one of which is shown in FIG. 2) formed on its outer surface, and a centrifugal shoe 47 is swingably supported on the mounting bosses 46. The centrifugal shoe 47 constitutes a centrifugal clutch 48 together with a clutch drum 48 secured to a drive shaft 50 which will be described hereinafter. When the rotational speed of the crankshaft 13 exceeds a predetermined value, the centrifugal shoe 47 is brought into pressure contact with an inner peripheral wall of the clutch drum 48 by its own centrifugal force to transmit a torque output from the crankshaft 13 to the drive shaft 50. The cooling fan 43 has a diameter larger than that of the centrifugal clutch 48.

An engine cover 51 covering the engine body 1 and accessories excluding the fuel tank 5 is secured at place to the engine body 1, and a cooling-air introduction opening 19 is provided between the engine cover 51 and the fuel tank 5. Therefore, the outside air is introduced through the cooling-air introduction opening 19 by the rotation of the cooling fan 43 and put into the cooling various portions of the engine E.

A truncated conical bearing holder 58 is secured to the engine cover 51 and arranged coaxially with the crankshaft 13. The bearing holder 58 supports the drive shaft 50 for driving the cutter C in rotation through a bearing 59.

The oil tank 40 and the starter 42 are disposed on one side of the engine body 1, and the cooling fan 43 and the centrifugal clutch 49 are disposed on the other side of the engine body 1. Therefore, the lateral balance of the engine E is improved and hence, the center of gravity the engine E can be put at a location close to a central portion of the crankshaft 13, leading to an enhancement in operability of the engine E.

The cooling fan 43 having the diameter larger than that of the centrifugal shoe 47 is secured to the crankshaft 13 between the engine body 1 and the centrifugal shoe 47 and hence, an increase in size of the engine E due to the provision of the cooling fan 43 can be avoided to the utmost.

The structures of the engine body 1 and the oil tank 40 will be described below with reference to FIGS. 2 to 5, 6, 10 and 11.

Referring to FIGS. 2 to 5, the engine body 1 comprises a crankcase 6 having a crank chamber 6*a*, a cylinder block 7 having a single cylinder bore 7*a*, and a cylinder head 8 having a combustion chamber 8*a* and an intake and exhaust ports 9 and 10 which open into the combustion chamber 8*a*. A large number of cooling fins 38 are formed around an outer periphery of each of the cylinder block and the cylinder head 8.

The crankshaft 13 accommodated in the crank chamber 6*a* is rotatably carried on laterally opposite sidewalls of the crankcase 6 with ball bearings 14 and 14' interposed therebetween. In this case, the left ball bearing 14 has a seal, and an oil seal 17 is disposed outside and adjacent the right ball bearing 14'. As conventionally usual, a piston 15 received in the cylinder bore 7*a* is connected to the crankshaft 13 through a connecting rod 16.

The oil tank 40 is integrally connected to the left sidewall of the crankcase 6 to adjoin the outside of the crankcase 6, and the crankshaft 13 is disposed so that its end on the side of the ball bearing 14 having the seal is passed through the oil tank 40. An oil seal 39 is mounted to an outer sidewall of the oil tank 40, through which the crankshaft 13 extends.

A belt guide tube 86 flat in section is integrally connected to a ceiling wall of the oil tank 40 to extend vertically through the ceiling wall with its vertically opposite ends opened. The belt guide tube 86 extends with its lower end reaching a point near the crankshaft 13 within the oil tank 40 and with its upper end integrally connected to the cylinder head 8 to share a partition wall with the cylinder head 8. A series of annular seal beads 87 are formed at peripheral edges of the upper ends of the belt guide tube 86 and the cylinder head 8, and the partition wall 85 protrudes above the seal beads 87.

Figure 6:
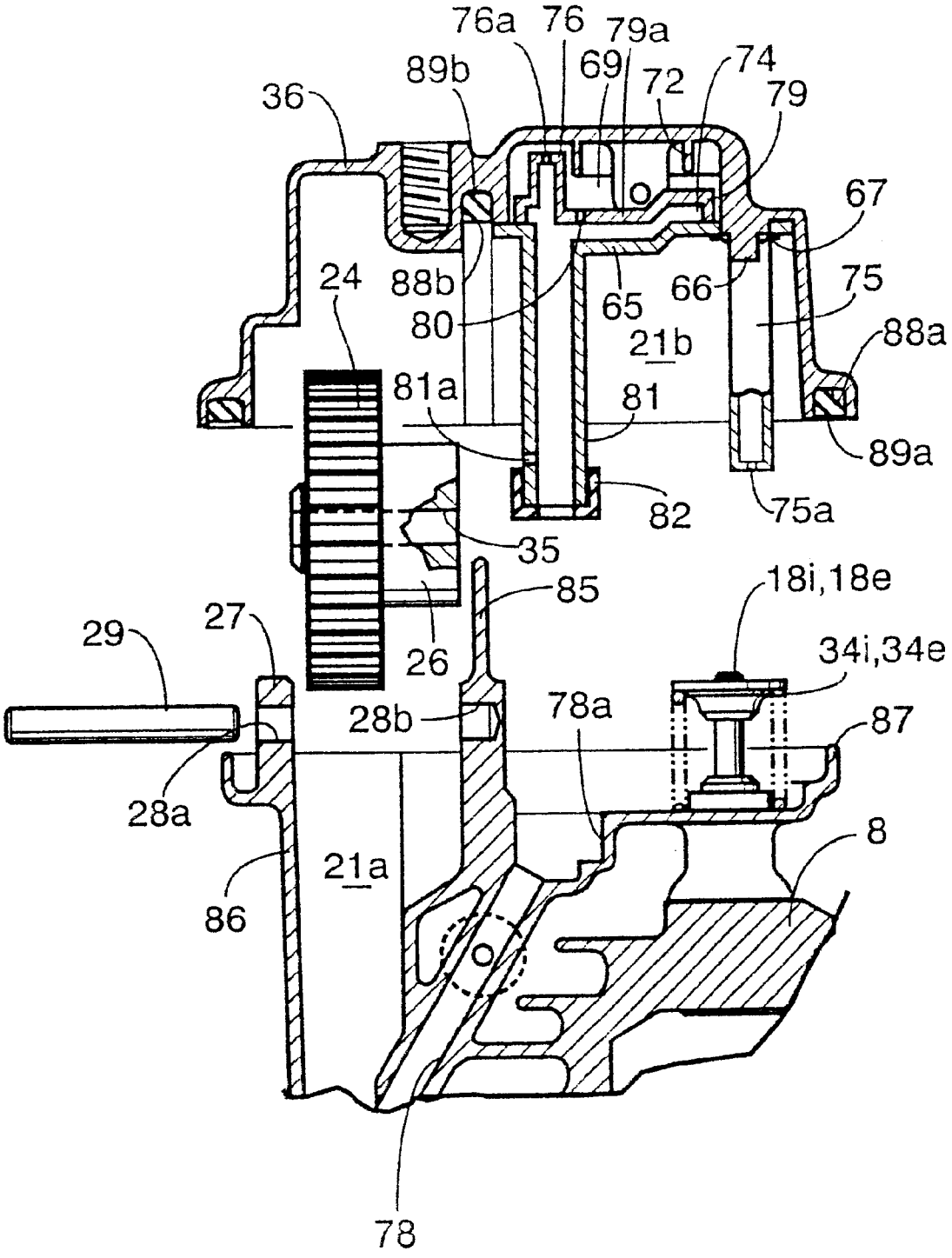
FIG. 6 is an exploded view of the essential portion shown in FIG. 5.
Figure 7:
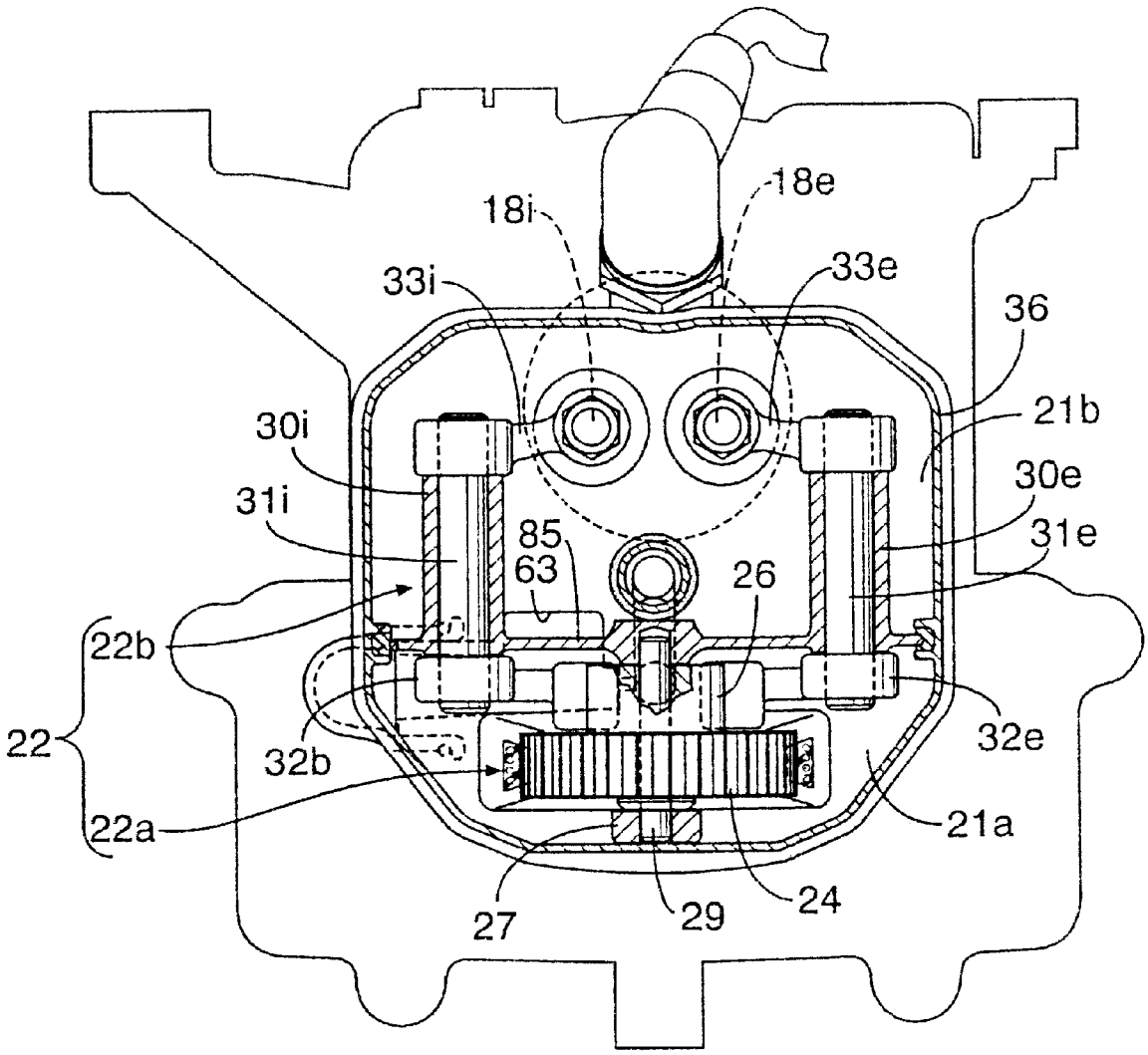
FIG. 7 is a sectional view taken along a line 7—7 in FIG. 4.
Figure 8:
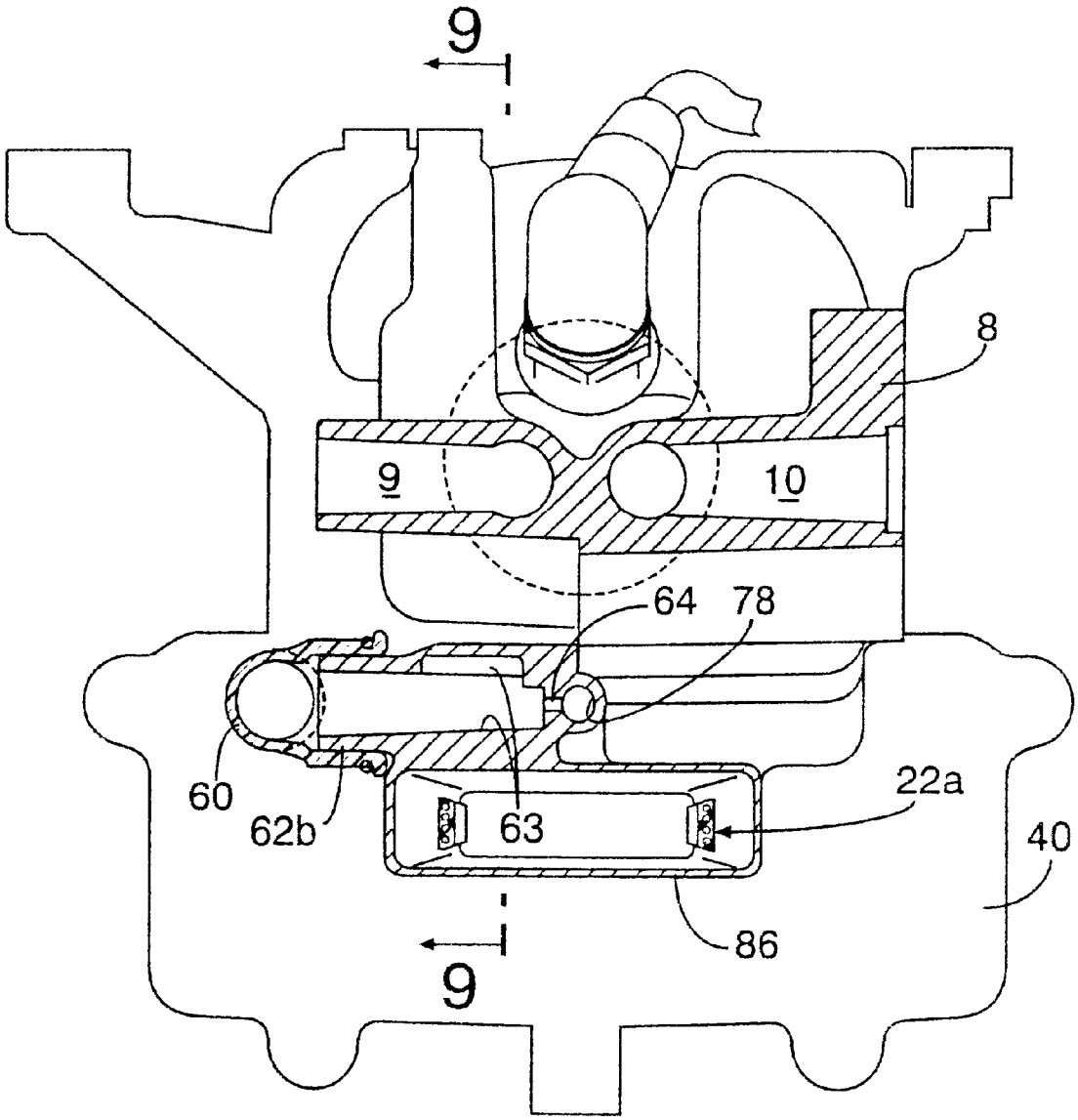
FIG. 8 is a sectional view taken along a line 8—8 in FIG. 4.
Figure 9:
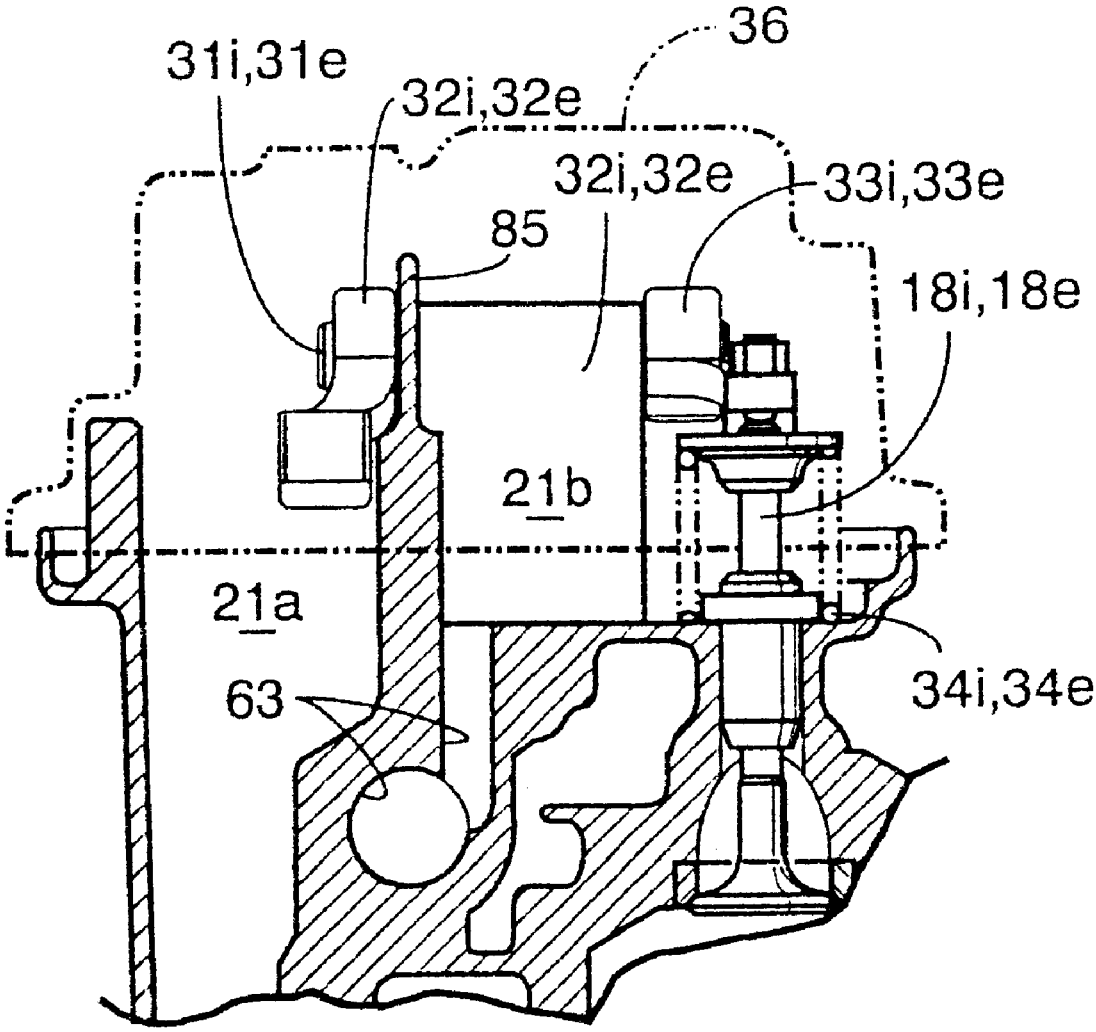
FIG. 9 is a sectional view taken along a line 9—9 in FIG. 8.
Figure 10:
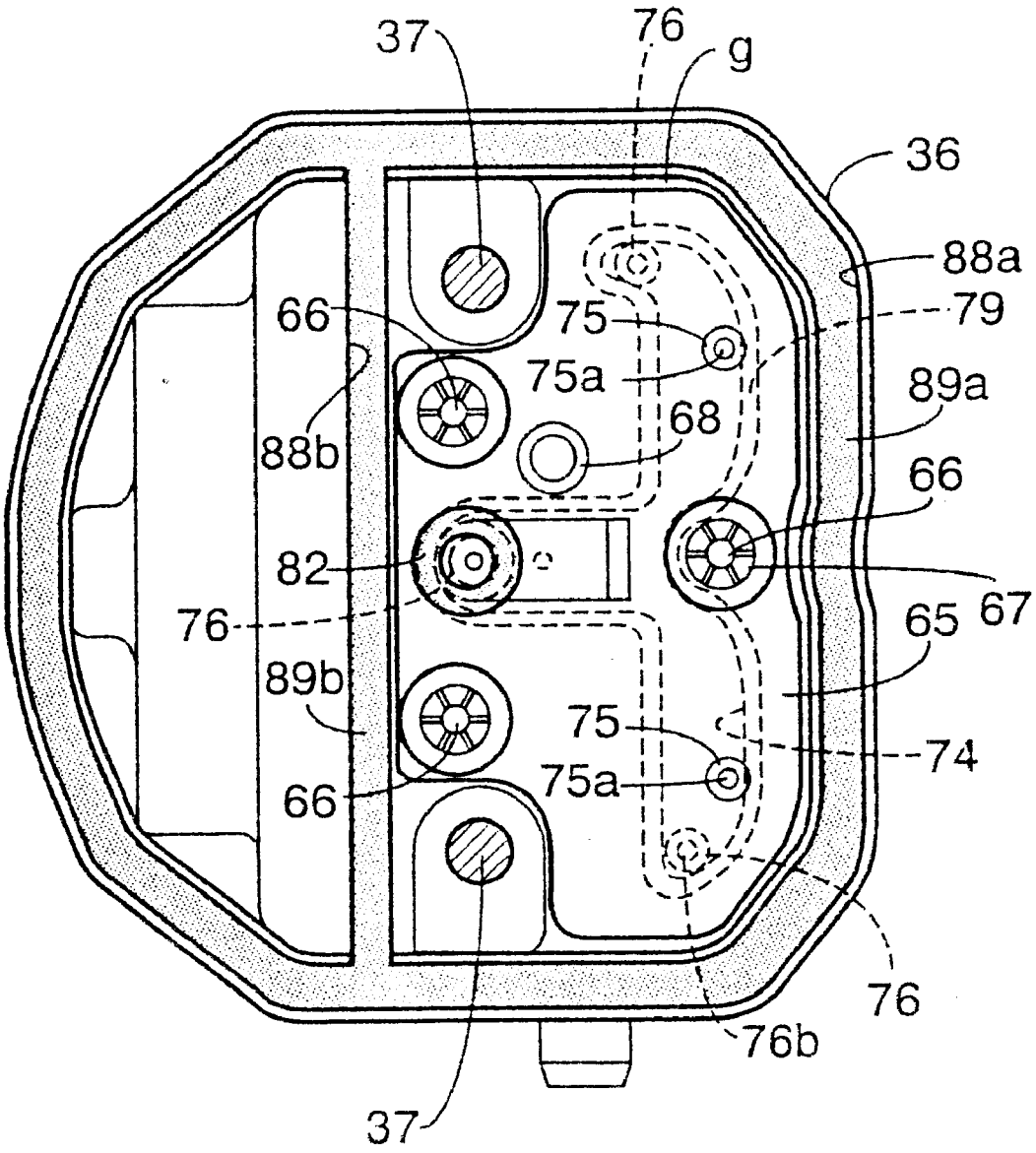
FIG. 10 is a view taken along a line 10—10 in FIG. 5 (a bottom view of a head cover)
Figure 11:
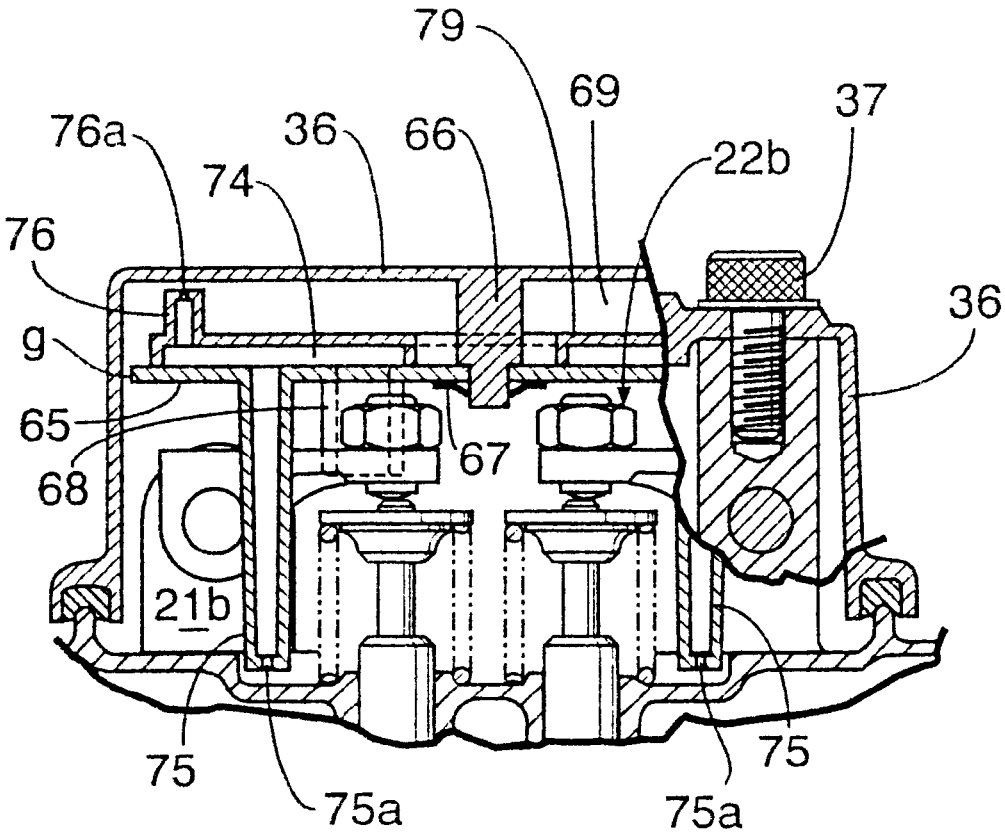
FIG. 11 is a sectional view taken along a line 11—11 in FIG. 5.
Figure 12:
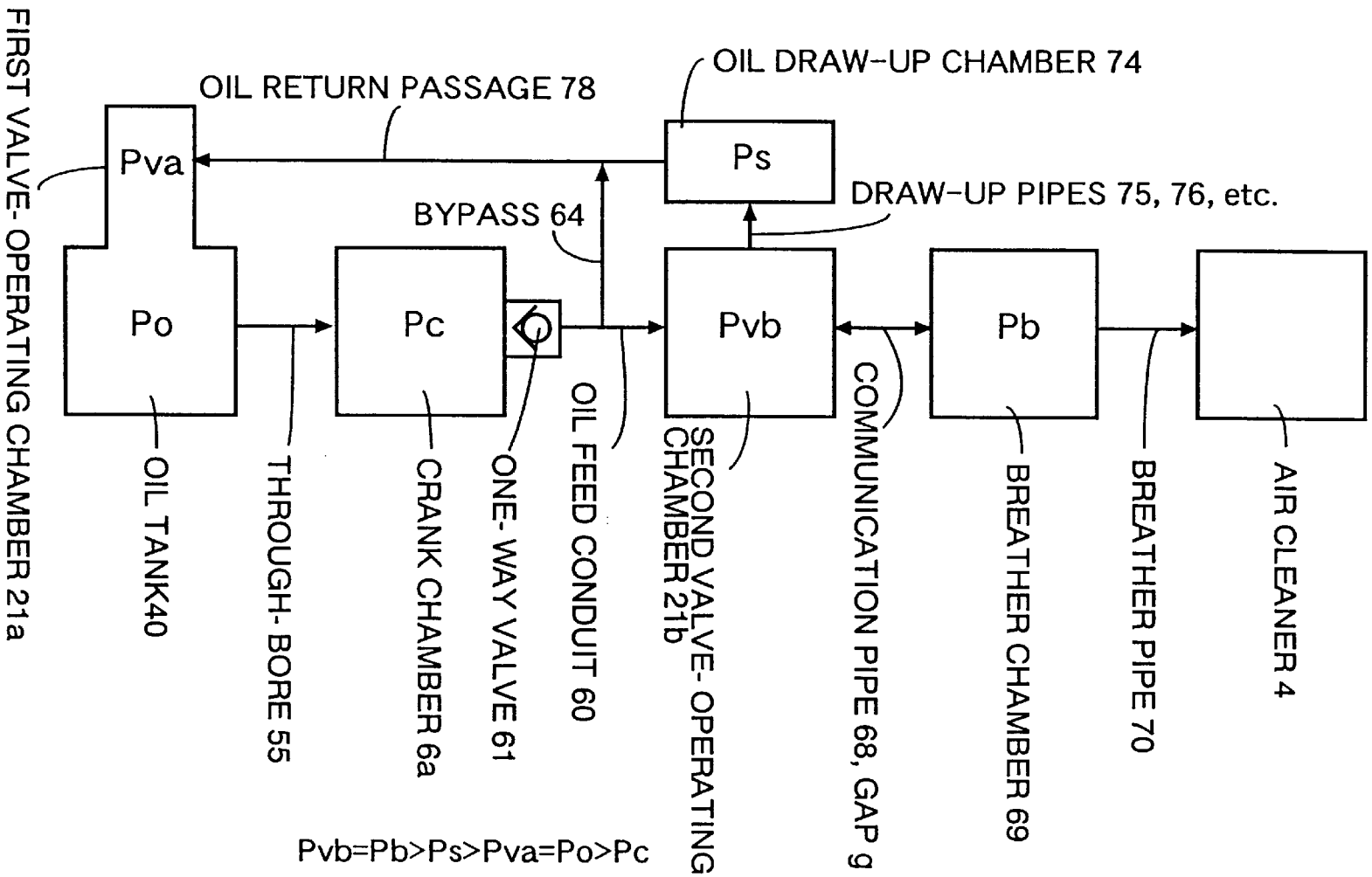
FIG. 12 is a diagram showing lubricating courses in the engine.

On the other hand, as shown in FIGS. 6, 10 and 11, an annular seal groove 88*a* corresponding to the seal beads 87 are formed in the lower end face of the head cover 36, and a linear seal groove 88*b* is formed in an inner surface of the cover 36 to permit the communication between the opposite sides of the annular seal groove 88*a*. An annular packing 89*a* is mounted in the annular seal groove 88*a*, and a linear packing 89*b* formed integrally with the annular packing 89*a* is mounted in the linear seal groove 88*b*. The head cover 36 is coupled to the cylinder head 8 by a bolt 37, so that the seal beads 87 are in pressure contact with the annular packing 89*a*, and the partition wall 85 is in pressure contact with the linear packing 89*b*.

A first valve-operating chamber 21*a* is defined by the belt guide tube 86 and one of halves of the head cover 36, and a second valve-operating chamber 21*b* is defined by the cylinder head 8 and the other half of the head cover 36. The valve-operating chambers 21*a* and 21*b* are partitioned from each other by the partition wall 85.

Referring again to FIGS. 2 to 5, the engine body 1 and the oil tank 40 are bisected into an upper block Ba and a lower block Bb by a plane which passes an axis of the crankshaft 13 and which is perpendicular to an axis of the cylinder bore 7*a*. More specifically, the upper block Ba is constituted by upper half of the crankcase 6, the cylinder block 7, the cylinder head 8, upper half of the oil tank 40 and the belt guide tube 86, which are integrally connected together. The lower block Bb is constituted by lower half of the crankcase 6 and lower half of the oil tank 40, which are integrally connected to each other. The upper and lower blocks Ba and Bb are formed individually by a casting process and coupled to each other by a plurality of bolts 12 (see FIG. 4) after processing of their various portions.

An intake valve 18*i* and an exhaust valve 18*e* are provided in the cylinder head 8 in parallel to the axis of the cylinder bore 7*a* for opening and closing the intake port 9 and the exhaust port 10, respectively, and a spark plug 20 is threadedly mounted in the cylinder head 8 with its electrode disposed in proximity to a center portion of the combustion chamber 8*a*.

A valve-operating mechanism 22 for opening and closing the intake valve 18*i* and the exhaust valve 18*e* will be described below with reference to FIGS. 3 to 7.

The valve-operating mechanism 22 is comprised of a timing transmitting device 22*a* disposed to extend from the inside of the oil tank 40 to the first valve-operating chamber 21*a*, and a cam device 22*b* disposed to extend from the first valve-operating chamber 21*a* to the second valve-operating chamber 21*b*.

The timing transmitting device 22*a* comprises a driving pulley 23 fixedly mounted on the crankshaft 13 within the oil tank 40, a driven pulley 24 rotatably supported at the upper portion of the belt guide tube 86, and a timing belt 25 reeved between the driving and driven pulleys 23 and 24. A cam 26 constituting a portion of the cam device 22*b* is integrally coupled to an end face of the driven pulley 24 adjacent the partition wall 85. The driving and driven pulleys 23 and 24 are toothed. The driving pulley 23 is adapted to drive the driven pulley 24 at a reduction ratio of ½ through the belt 25.

A support wall 27 is integrally formed on an outer sidewall of the belt guide tube 86 to rise inside the annular seal beads 87 to abut against or adjoin the inner surface of the head cover 36. A support shaft 29 is rotatably supported at its opposite ends by a through-bore 28*a* provided in the support wall 27 and a bottomed bore 28*b* provided in the partition wall 85, and the driven pulley 24 and the cam 26 are rotatably carried at an intermediate portion of the support shaft 29. Before attachment of the head cover 36, the support shaft 29 is inserted through the through-bore 28*a* into an axial bore 35 in the driven pulley 24 and the cam 26 and the bottomed bore 28*b*. When the head cover 36 is coupled to the cylinder head 8 and the belt guide tube 86 after such insertion, the inner surface of the head cover 36 is opposed to an outer end of the support shaft 29 to prevent the slipping-off of the support shaft 29.

A pair of gearing bosses 30*i* and 30*e* are integrally formed on the partition wall 85 to protrude toward the second valve-operating chamber 21*b* in parallel to the support shaft 29. The cam device 22*b* comprises an intake rocker shaft 31*i* and an exhaust rocker shaft 31*e* which are rotatably supported on the bearing bosses 30*i* and 30*e*, respectively, an intake cam follower 22*i* and an exhaust cam follower 22*e* which are secured to one ends of the rocker shafts 31*i* and 31*e* within the first valve-operating chamber 21*a* with their tip ends in sliding contact with a lower surface of the cam 26, respectively, an intake rocker arm 33*i* and an exhaust rocker arm 33*e* which are secured to the other ends of the rocker shafts 31*i* and 31*e* within the second valve-operating chamber 21*b* with their tip ends in abutment against upper ends of the intake valve 18*i* and the exhaust valve 18*e*, respectively, an intake spring 34*i* and an exhaust spring 34*e* mounted to the intake valve 18*i* and the exhaust valve 18*e* for biasing these valves inclosing directions, respectively.

When the driving pulley 23 rotated along with the crankshaft 13 during rotation of the crankshaft 13 drives the driven pulley 24 and the cam 26 through the belt 25, the cam 26 causes the intake and exhaust cam followers 32*i* and 32*e* to be swung properly. Such swinging movements are transmitted through the corresponding rocker shafts 31*i* and 31*e* to the intake and exhaust rocker arms 33*i* and 33*e* to swing them. Therefore, the intake and exhaust valves 18*i* and 18*e* can be opened and closed properly by cooperation with the intake and exhaust springs 34*i* and 34*e*.

In the timing transmitting device 22*a*, the driven pulley 24 and the cam 26 are rotatably supported on the support shaft 29, and the support shaft 29 is rotatably supported on the opposite sidewalls of the first valve-operating chamber 21*a*. Thus, during rotation of the driven pulley 24 and the cam 24, the support shaft 29 is also rotated in such a manner that it is dragged by the friction, leading to a decreased difference between the rotational speeds of the driven pulley 24 as well as the cam 26 and the support shaft 29, thereby enabling a reduction in wearing of the rotational sliding portions. This can contribute to an enhancement in durability of the cam 26 and the support shaft 29 without use of a special material and a surface treatment.

The cam 26 having a relatively large diameter is disposed on one side of the cylinder head 8 along with the driven pulley 24, and only the intake and exhaust rocker arms 33*i* and 33*e* and the intake and exhaust rocker shafts 31*i* and 31*e* having relatively large diameters are disposed immediately above the cylinder head 8. Therefore, the valve-operating mechanism 22 cannot be largely bulky upwards of the cylinder head 8, which can contribute to a reduction in entire height of the engine E and in its turn, to the compactness of the engine E.

The support shaft 29 and the intake and exhaust rocker shafts 31*i* and 31*e* are disposed above the series of annular seal beads 87 at the upper ends of the cylinder head 8 and the belt guide tube 86 and hence, cannot be obstructed in any way by the seal beads 87 in a state in which the head cover 36 has been removed. Thus, it is possible to assemble and disassemble the support shaft 29 and the intake and exhaust rocker shafts 31*i* and 31*e* above the annular beads, leading to extremely improved assemblability and maintenance.

A lubricating system in the engine E will be described below with reference to FIGS. 3 to 12.

Figure 4:
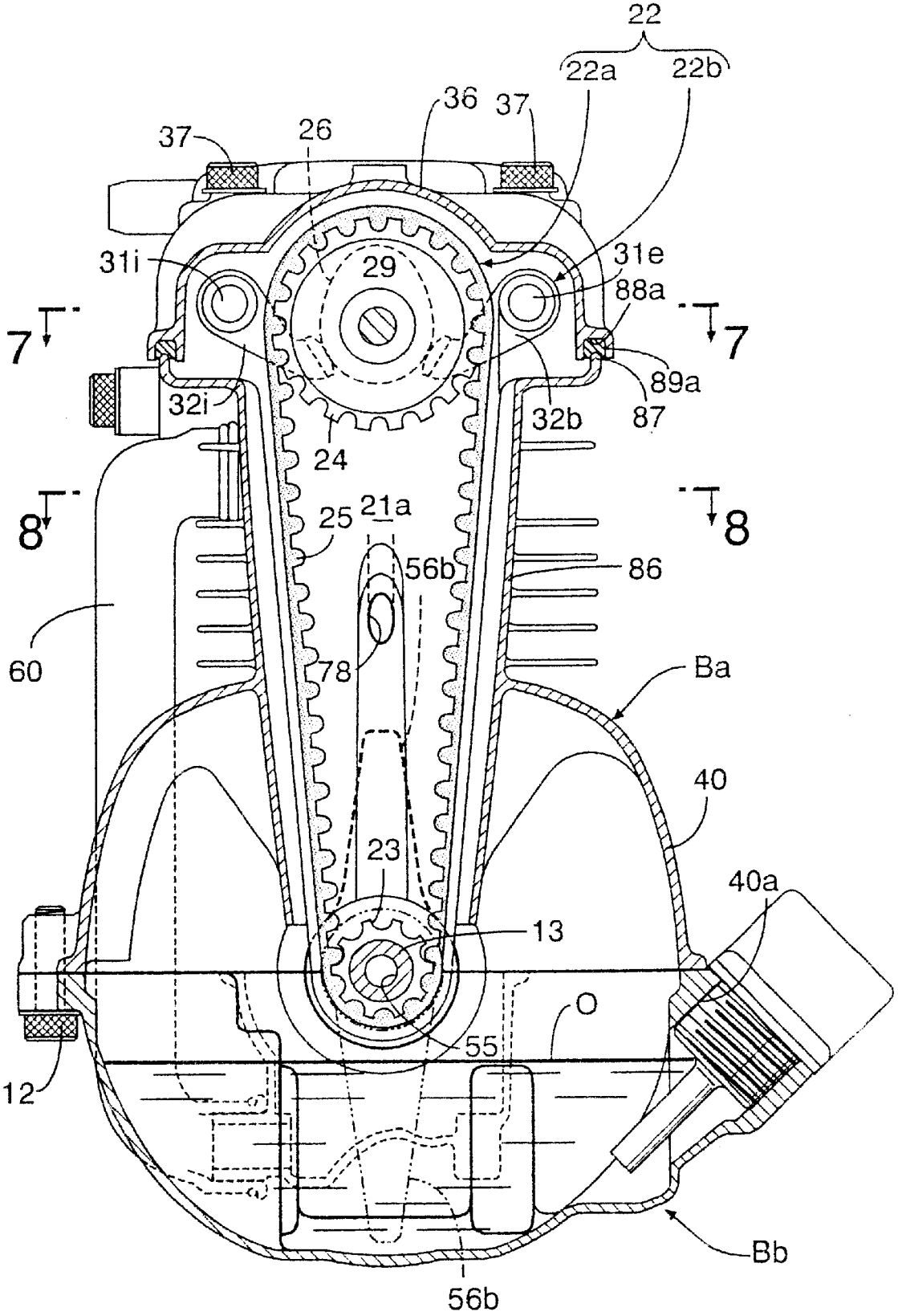
FIG. 4 is a sectional view taken along a line 4—4 in FIG. 2.
Figure 5:
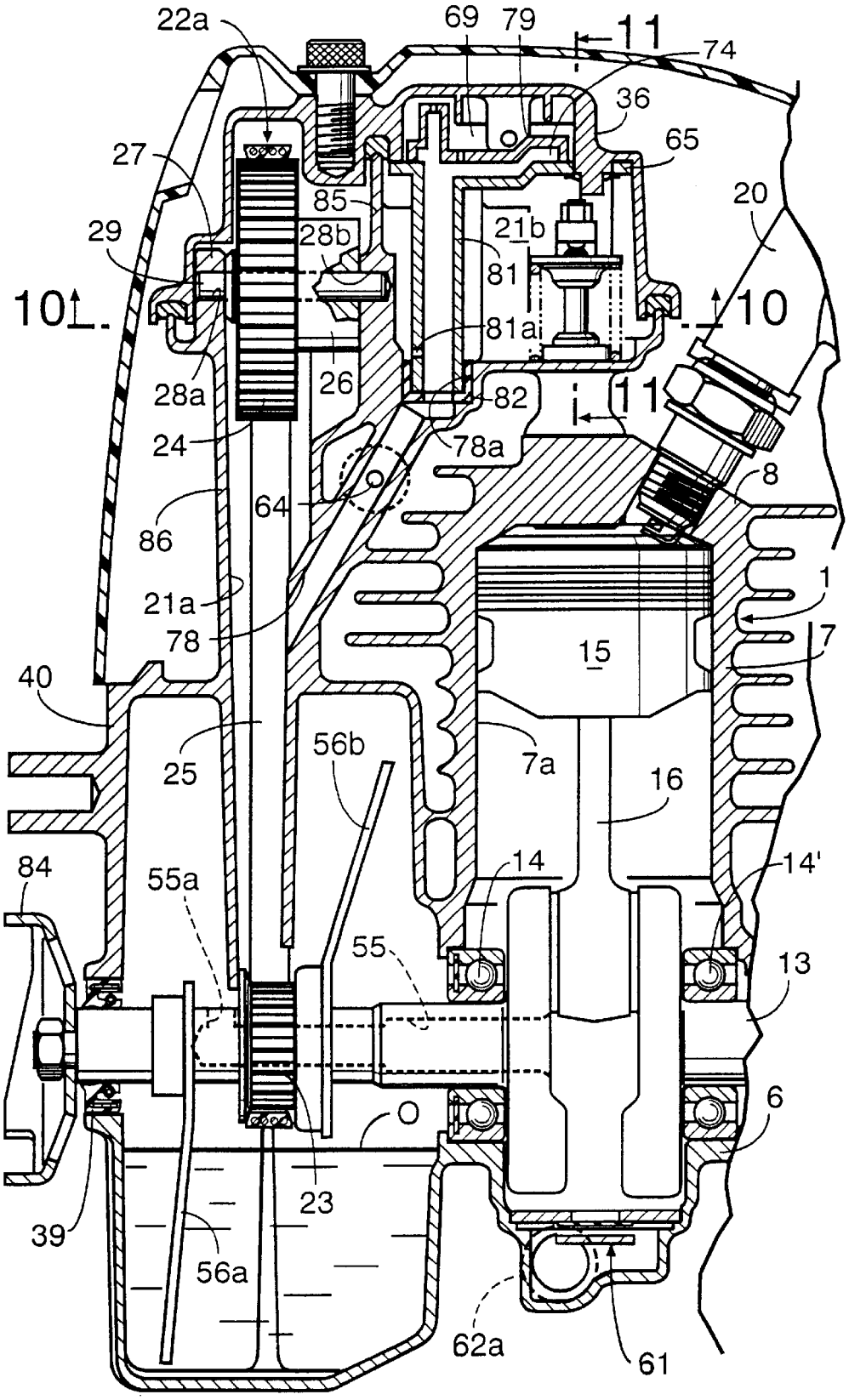
FIG. 5 is an enlarged sectional view of an essential portion shown in FIG. 2.

Referring to FIGS. 4 and 5, a defined amount of lubricating oil O poured through an oil supply port 40*a* is stored in the oil tank 40. A pair of oil slingers 56*a* and 56*b* are secured to the crankshaft 13 within the oil tank 40 by press fitting or by another means and arranged axially with the driving pullet 23 interposed therebetween. The oil slingers 56*a* and 56*b* are bent to face in exact opposite radial directions with their tip ends axially spaced apart from each other. When the oil slingers 56*a* and 56*b* are driven in rotation by the crankshaft 13, at least one of the oil slingers

56*a* and 56*b* stirs and scatters the oil O stored in the oil tank 40 in any operational attitude of the engine E to produce an oil mist. At this time, the generated oil splash is sprinkled over a portion of the timing transmitting device 22*a* exposed to the inside of the oil tank 40 from the first valve-operating chamber 21*a*, or is permitted to enter the first valve-operating chamber 21*a*, thereby lubricating the timing transmitting device 22*a* directly. This is one line of the lubricating system.

As shown in FIGS. 3 to 5 and 12, another lubricating line includes a through-bore 55 provided in the crankshaft 13 to permit the communication between the inside of the oil tank 40 and the crank chamber 6*a,* an oil feed conduit 60 disposed outside the engine body 1 to connected a lower portion of the crank chamber 6*a* to a lower portion of the second valve-operating chamber 21*b*, an oil recovery chamber 74 provided in the cylinder head 8 to draw up the oil liquefied and accumulated in the second valve-operating chamber 21*b*, an oil return passage 78 defined between the cylinder head 8 and the oil tank 40 to permit the oil recovery chamber 74 to communicate with the oil tank 40 through the first valve-operating chamber 21*a*, and a one-way valve 61 mounted in the lower portion of the crank chamber 6*a* for permitting the flowing of the oil mist only in a direction from the crank chamber 6*a* to the oil return passage 60.

An end 55*a* of the through-bore 55 opening into the oil tank 40 is disposed at or in the vicinity of a center portion of the tank 40, so that it is always exposed above the surface of the oil O in the oil tank 40 in any operational attitude of the engine E. The driving pulley 23 secured to the crankshaft 13 and one of the oil slingers 56*a* are disposed with the open end 55*a* located therebetween, so that the open end 55*a* is not closed.

The one-way valve 61 (see FIG. 3) comprises a reed valve in the illustrated embodiment and is adapted to be closed when the inside of the crank chamber 6*a* is brought into a negative pressure with the reciprocal movement of the piston 15, and to be opened when the inside of the crank chamber 6*a* is brought into a positive pressure.

The oil feed conduit 60 is connected at its lower end fitted over and connected to a lower connecting pipe 62*a* (see FIG. 3) projectingly provided on the outer side of the crankcase 6 and at its upper end fitted over and connected to an upper connecting pipe 62*b* (see FIGS. 4 and 8) projectingly provided on the outer side of the cylinder head 8. The inside of the upper connecting pipe 62*b* communicates with the lower portion of the second valve-operating chamber 21*b* through a communication passage 63 (see FIGS. 8 and 9) defined in the cylinder head 8 and having a large area, on the one hand, and communicates with the oil return passage 78 through an orifice-shaped bypass 64 (see FIG. 8), on the other hand.

As shown in FIGS. 5, 10 and 11, a partitioning plate 65 attached to the ceiling wall of the head cover 36 by a plurality of support pillars 66 projectingly provided on the ceiling wall and clips 67 locked to the support pillars 66, thereby defining a breather chamber 69 in an upper portion of the inside of the head cover 36. The breather chamber 69 communicates with the second valve-operating chamber 21*b* through a communication pipe 68 having a large flow path area and protruding toward the second valve-operating chamber 21*b* integrally defined in the partitioning plate 65 and through a gap g between the partitioning plate 65 and the inner surface of the head cover 36, on the one hand, and communicates with the inside of the are cleaner 4 through a breather pipe 70, on the other hand. In the breather chamber 69, the gas-liquid separation of the oil and a blow-by gas, which are in a mixed state, is carried out, and a maze wall 72 for promoting the gas-liquid separation is projectingly provided on an inner surface of the ceiling wall of the head cover 36.

A box-shaped partitioning member 79 of a T-shape as viewed in a plane with one surface opened is welded to the partitioning plate 65 to define the oil recovery chamber 74 between the partitioning member 79 and an upper surface of the partitioning plate 65 and hence, the oil recovery chamber 74 is also of a T-shape.

The partitioning plate 65 has two draw-up pipes 75 integrally and projectingly provided thereon to communicate with two points corresponding to opposite ends of a lateral bar portion of the T-shape of the oil recovery chamber 74. The draw-up pipes 75 extend with their tip ends reaching near the bottom surface of the second valve-operating chamber 21*b*, and openings in such tip ends are orifices 75*a*.

The partitioning member 79 has three draw-up pipes 76 integrally and projectingly provided on an upper wall thereof to communicate with three points corresponding to tip ends of the lateral bar portion and a vertical bar portion of the T-shape of the oil recovery chamber 74. The draw-up pipes 76 extend with their tip ends reaching near the ceiling surface of the breather chamber 69, and openings in such tip ends are orifices 76*a*.

Further, the partitioning plate 65 has an orifice 80 provided in its upper wall to permit a recess 65*a* in its upper surface to communicate with the oil recovery chamber 74.

In addition, the partitioning plate 65 has a single conduit 81 integrally and projectingly provided thereon to communicate with a portion corresponding to the tip end of the vertical bar portion of the T-shape of the oil recovery chamber 74. The conduit 81 has a tip end fitted through a grommet 82 into an entrance 78*a* of the oil return passage 78, which opens into the bottom surface of the second valve-operating chamber 21*b*. In this manner, the oil recovery chamber 74 is connected to the oil return passage 78. The conduit 81 is disposed in proximity to one inner side of the second valve-operating chamber 21*b*, and an orifice 81*a* for drawing up the oil is provided in the conduit 81 at a location near such inner side to permit the second valve-operating chamber 21*b* to communicate with the inside of the conduit 81.

Thus, the breather chamber 60 communicates with the inside of the air cleaner 4 through the breather pipe 70 and hence, even during operation of the engine E, the pressure in the breather chamber 69 is maintained at the substantially atmospheric pressure, and the second valve-operating chamber 21*b* communicating with the breather chamber through the communication pipe 68 having a small flow path resistance is at the substantially same pressure as in the breather chamber 69.

The inside of the crank chamber 6*a* is averagely brought into a negative pressure, because the crank chamber 6*a* discharges only a positive pressure component of a pressure pulsation produced by the lifting and lowering of the piston 15 through the one-way valve 61 into the oil feed conduit 60 during operation of the engine. The inside of the second valve-operating chamber 21*b* receiving such positive pressure is brought into the substantially same pressure as in the breather chamber, because it communicates with the breather chamber 69 through the communication pipe 68 having a small flow path resistance. The negative pressure in the crank chamber 6*a* is transmitted via the through-bore 55 in the crankshaft 13 to the oil tank 40 and further through the oil return passage 78 to the oil recovery chamber 74. Therefore, the inside of the oil recovery chamber 74 is brought into a pressure lower than those in the second valve-operating chamber 21*b* and the breather chamber 69, and the insides of the oil tank 40 and the first valve-operating chamber 21*a* are brought into a pressure lower than that in the oil recovery chamber 74.

Therefore, if the pressure in the crank chamber 6*a* is represented by Pc; the pressure in the oil tank 40 is by Po; the pressure in the first valve-operating chamber 21*a* is by Pva; the pressure in the second valve-operating chamber 21*b* is by Pvb; the pressure in the oil recovery chamber 74 is by Ps; and the pressure in the breather chamber 69 is by Pb, the pressure-magnitude relationship can be represented by the following expression:

$$Pvb=Pb>Ps>Po=Pva>Pc$$

As a result, the pressures in the second valve-operating chamber 21 and the breather chamber 69 are moved through the draw-up pipes 75 and 76 and the orifice 80 to the oil recovery chamber 74 and further through the oil return passage 78 to the oil tank 40 and then to the crank chamber 6*a*.

During operation of the engine E, the oil mist is produced in the oil tank 40 by stirring and scattering the lubricating oil O by the oil slingers 56*a* and 56*b* rotated by the crankshaft 13. The oil splash generated at this time is sprinkled over a portion of the timing transmitting device 22*a* exposed from the belt guide tube 86 into the oil tank 40, i.e., portions of the driving pulley 23 and the timing belt 25, or permitted to enter the first valve-operating chamber 21*a* to lubricate the timing transmitting device 22*a* directly, as already described above. When the oil splash is sprinkled over even a portion of the timing transmitting device 22*a*, the oil can be transferred not only to the entire device 22*a* but also to the cam 26 to lubricate them.

The oil mist produced in the oil tank 40 is drawn into the crank chamber 6*a* through the through-bore 55 in the crankshaft 13 in accordance with a flowing of the pressure to lubricate the periphery of the piston 15. When the inside of the crank chamber 6*a* is then brought into a positive pressure by the lowering of the piston 15, the oil mist is permitted to flow upwards through the oil feed conduit 60 and the communication passage 63 along with the blow-by gas generated in the crank chamber 6*a* by opening of the one-way valve 61 and thus supplied to the second valve-operating chamber 21*b* to lubricate various portions of the cam device 22*b* within the second valve-operating chamber 21*b*, i.e., the intake and exhaust rocker arms 33*i* and 33*e* and the like.

In this case, a portion of the oil mist passing through the communication passage 63 is short-circuited from the orifice-shaped bypass 64 to the oil return passage 78. Therefore, the amount of oil mist supplied to the second valve-operating chamber 21*b* can be regulated by setting the flow path resistance of the bypass 64 suitably.

When the oil mist and the blow-by gas in the second valve-operating chamber 21*b* are passed through the communication pipe 68 and the gap g around the partitioning plate 65 into the breather chamber 69, they are separated from each other by their actions of expansion and collision against the maze wall 72. The blow-by gas is drawn into the engine E sequentially via the breather pipe 70 and the air cleaner 4 during an intake stroke of the engine E.

In a upright state of the engine E, the oil liquefied in the breather chamber 69 is accumulated in the recess in the upper surface of the partitioning member 79, or permitted to flow downwards through the communication pipe 68 and the gap g and accumulated on the bottom surface of the second valve-operating chamber 21*b* and hence, is drawn up into the oil recovery chamber 74 by the orifice 80 and the draw-up pipe 75 which are on standby at such place. In an upside-down state of the engine E, the liquefied oil is accumulated on the ceiling surface of the head cover 36 and hence, is drawn up into the oil recovery chamber 74 by the draw-up pipe 76 which is on standby at such place.

The oil drawn up into the oil recovery chamber 74 in this manner is circulated from the conduit 81 through the oil return passage 78 into the oil tank 40. In this case, if the oil return passage 78 is put into communication with the oil tank 40 through the second valve-operating chamber 21*b* as in the illustrated embodiment, the oil exiting the oil return passage 78 is sprinkled over the timing transmitting device 22*a* to contribute to the lubrication of the timing transmitting device 22*a*, which is advantageous.

The breather chamber 69 is defined between the ceiling surface of the had cover 36 and the partitioning plate 65 mounted to the inner wall of the head cover 36, and the oil recovery chamber 74 is defined between the upper surface of the partitioning plate 65 and the portioning member 79 welded to the partitioning plate 65. Therefore, the oil recovery chamber 74 and the breather chamber 69 can be provided in the head cover 36 without division of the ceiling wall of the head cover 36. Moreover, both of the breather chamber 69 and the oil recovery chamber 74 exist within the head cover 36 and hence, even if a small amount of the oil is leaked from both of the chambers 69 and 74, the leaked oil is merely returned to the second valve-operating chamber 21*b* and brings about no impedance. Therefore, an inspection for an oil-tightness around the chambers 69 and 74 is not required, thereby enabling a reduction in manufacture cost.

Moreover, the partitioning member 79 is capable of being welded to the partitioning plate 65 before attachment of the partitioning plate 65 to the head cover 36 and hence, the formation of the oil recovery chamber 74 in the portioning plate 65 can be carried out simply.

Further, the oil draw-up pipes 75 and 76 are integrally formed on the partitioning plate 65 and the partitioning member 79, respectively and hence, the formation of the oil draw-up pipes 75 and 76 can be carried out simply.

Figure 13:
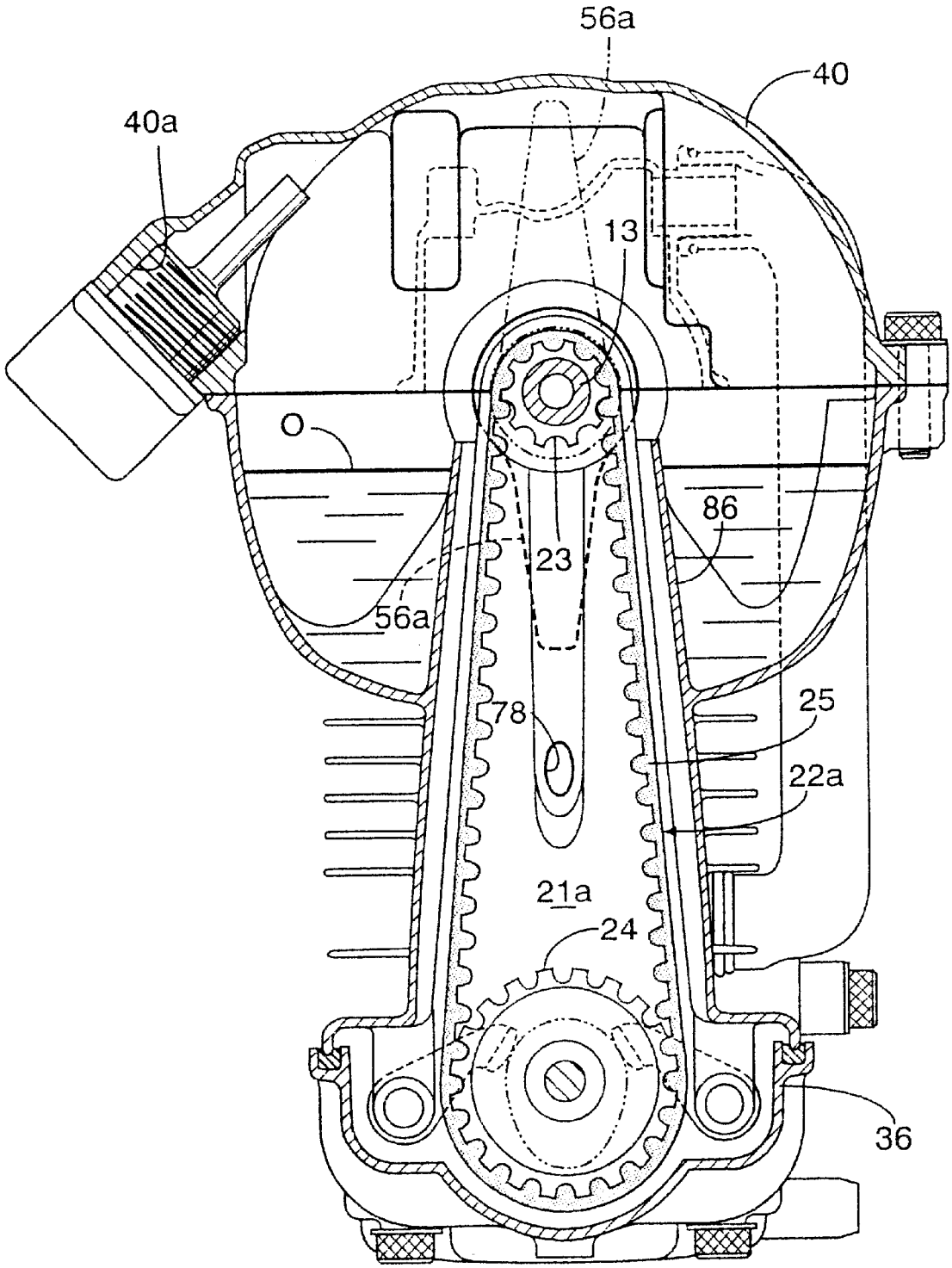
FIG. 13 is a view similar to FIG. 4, but showing the engine in its upside-down state.

On the other hand, when the engine E is brought into the upside-down state as shown in FIG. 13, the oil O stored in the oil tank 40 is moved toward the ceiling of the tank 40, i.e., toward the first valve-operating chamber 21*a*. However, the flowing of the stored oil O into the second valve-operating chamber 2 1*b* is not permitted, because the open end the first valve-operating chamber 21 a opening into the oil tank 40 is fixed by the belt guide tube 86 to occupy a position higher in level than the surface of the stored oil 0. Therefore, it is possible to prevent an excessive amount of the oil from being supplied to the timing transmitting device 22*a* and to ensure a predetermined amount of oil in the oil tank 40 to continue the production of the oil mist by the oil slingers 56*a* and 56*b*.

Figure 14:
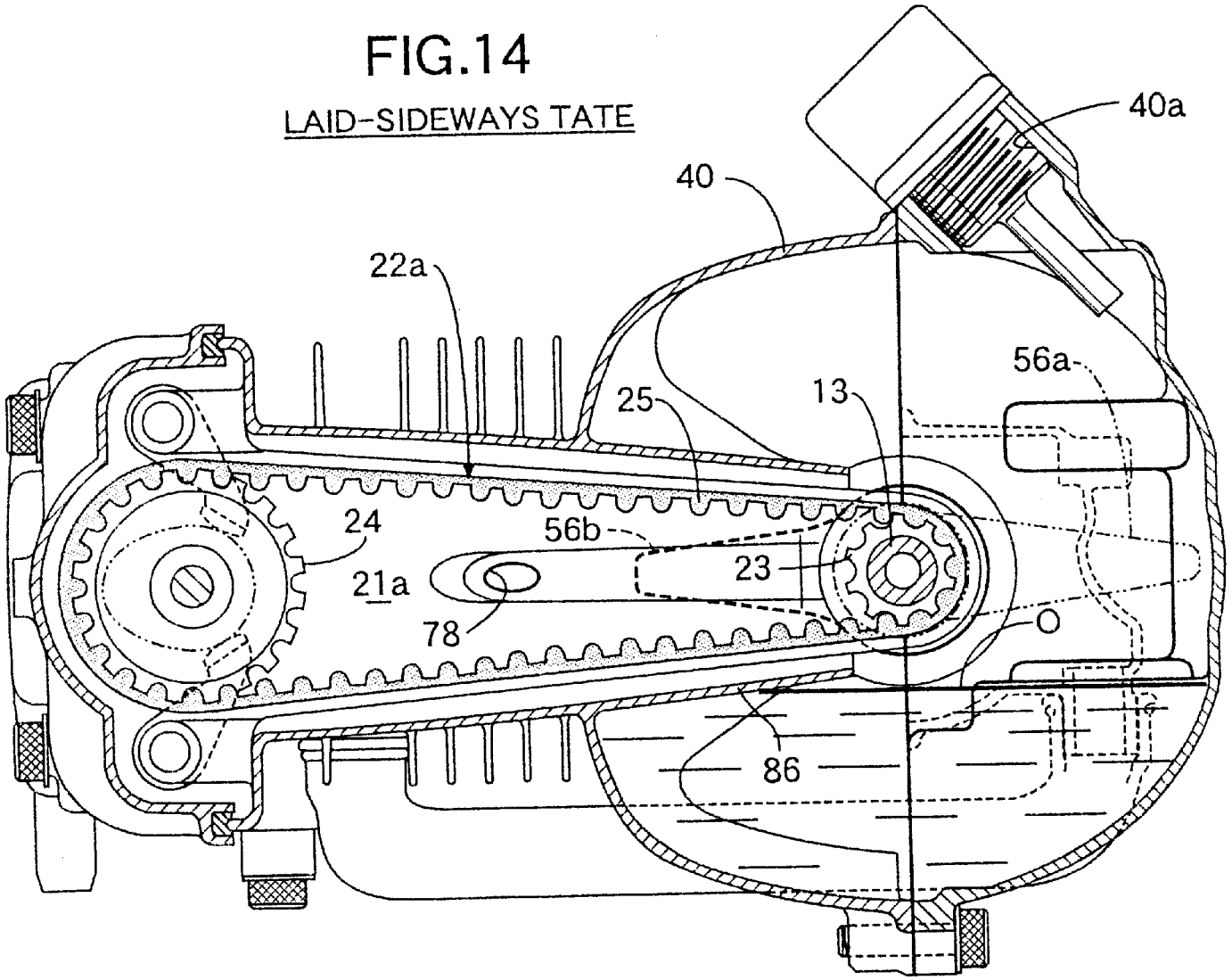
FIG. 14 is a view similar to FIG. 4, but showing the engine in its laid-sideways state.

When the engine E is brought into its laid-sideways state as shown in FIG. 14, the stored oil O is moved toward the side face of the tank 40. Even in this case, however, the flowing of the stored oil O into the second valve-operating chamber 21*b* is not permitted, because the open end the first valve-operating chamber 21*a* opening into the oil tank 40 is fixed by the belt guide tube 86 to occupy the position higher in level than the surface of the stored oil O. Therefore, it is possible to prevent an excessive amount of the oil from being supplied to the timing transmitting device 22*a* and to ensure a predetermined amount of oil in the oil tank 40 to continue the production of the oil mist by the oil slingers 56*a* and 56*b*.

Thus, the lubricating system for the valve-operating mechanism 22 is divided into two lines: the line for lubricating portions of the timing transmitting device 22*a* and the cam device 22*b* within the oil tank 40 and the first valve-operating chamber 21*a* by the scattered oil in the oil tank 40; and the line for lubricating the remaining portion of the cam device 22*b* within the second valve-operating chamber 21*b* by the oil mist transferred to the second valve-operating chamber 21*b*. Therefore, the burden on each of the lubricating system lines is alleviated, and the entire valve-operating mechanism can be lubricated thoroughly. Moreover, the use of the oil splash and the oil mist makes it possible to reliably lubricate the various portions of the engine even in any operational attitude of the engine.

In addition, the oil misted in the oil tank 40 is circulated by utilizing the pressure pulsation in the crank chamber 6*a* and the unidirectional transferring function of the one-way valve 61. Therefore, an exclusive oil pump for circulating the oil mist is not required and hence, the structure can be simplified.

Not only the oil tank 40 but also the oil feed conduit 60 connecting the crank chamber 6*a* and the second valve-operating chamber 21*b* are disposed outside the engine body 1 and hence, do not obstruct the thinning and the compactness of the engine body 1 in any way, thereby largely contributing to a reduction in weight of the engine E. Particularly, the oil feed conduit 60 disposed outside the engine body 1 is difficult to receive a thermal influence from the engine body 1 and moreover, is easy to dissipate a heat. Therefore, it is possible to promote the cooling of the oil mist passed through the oil feed conduit 60.

The oil tank 40 is disposed on one side of the engine body 1 and hence, it is possible to provide a remarkable reduction in entire height of the engine E. Moreover, a portion of the timing transmitting device 22*a* is accommodated in the oil tank 40 and hence, it is possible to suppress an increase in lateral width of the engine E to the utmost to provide the compactness of the engine E.

Although the embodiments of the present invention have been described in detail, it will be understood that the present invention is not limited to the above-described embodiments, and various modifications in design may be made without departing from the spirit and scope of the invention defined in claims. For example, the numbers of and the locations of placement of the oil draw-up pipes 75 and 76 and the draw-up orifices 80 and 81*a* may be selected freely. The Partitioning member 79 may be welded to the lower surface of the partitioning plate 65, and the oil recovery chamber 74 may be defined below the partitioning plate 65. In this case, the oil draw-up pipe 75 is integrally formed on the partitioning member 79, and the oil draw-up pipe 76 is integrally formed on the partitioning plate 75.

In addition, the one-way valve 61 may be replaced by a rotary valve operated in association with the crankshaft 13 to open the oil feed conduit 60 upon the lowering movement of the piston 15 and to close the oil feed conduit 60 upon the lifting movement of the piston 15.

What is claimed is:

1. A valve-operating mechanism in a 4-cycle engine comprising a timing transmitting device connected to a crankshaft, and a cam device for transmitting a rotational force of a driven rotary member of said timing transmitting device as an opening/closing force to intake and exhaust valves mounted in a cylinder head, wherein said timing transmitting device is disposed on one side of an engine body, and said cam device comprises a cam coupled to said driven rotary member of said timing transmitting device on one side of said cylinder head, intake and exhaust rocker shafts rotatably carried in said cylinder head, intake and exhaust cam followers secured to one ends of said rocker shafts with their tip ends in sliding contact with said cam, and intake and exhaust rocker arms secured to the other ends of said intake and exhaust rocker shafts with their tip ends abutting against said intake and exhaust valves, wherein said driven rotary member which is a driven pulley of said timing transmitting device is formed integrally on said cam and carried on said support shaft along with said cam, and said timing transmitting device is mounted to face the inside of an oil tank storing a lubricating oil and accommodating oil slingers for scattering the oil.

2. A valve-operating mechanism in a 4-cycle engine comprising a timing transmitting device connected to a crankshaft, and a cam device for transmitting a rotational force of a driven rotary member of said timing transmitting device as an opening/closing force to intake and exhaust valves mounted in a cylinder head, wherein said timing transmitting device is disposed on one side of an engine body, and said cam device comprises a cam coupled to said driven rotary member of said timing transmitting device on one side of said cylinder head, intake and exhaust rocker shafts rotatably carried in said cylinder head, intake and exhaust cam followers secured to one ends of said rocker shafts with their tip ends in sliding contact with said cam, and intake and exhaust rocker arms secured to the other ends of said intake and exhaust rocker shafts with their tip ends abutting against said intake and exhaust valves, further including a belt guide tube integrally connected to said cylinder head with its upper end opened and accommodating said timing transmitting device, a head cover coupled to said cylinder head and said belt guide tube to cover said timing transmitting device and said cam device from the above, and a support shaft supporting said driven rotary member and said cam, said support shaft and said rocker shafts being disposed above coupled portions of said cylinder head, said belt guide tube and said head cover.

3. A valve-operating mechanism in a hand-held 4-cycle engine having an oil tank, comprising a timing transmitting device connected to a crankshaft, and a cam device for transmitting a rotational force of a driven rotary member of said timing transmitting device as an opening/closing force to intake and exhaust valves mounted in a cylinder head, wherein said timing transmitting device is disposed on one side of an engine body, and said cam device comprises a cam coupled to said driven rotary member of said timing transmitting device on one side of said cylinder head, intake and exhaust rocker shafts rotatably carried in said cylinder head, intake and exhaust cam followers secured to one ends of said rocker shafts with their tip ends in sliding contact with said cam, and intake and exhaust rocker arms secured to the other ends of said intake and exhaust rocker shafts with their tip ends abutting against said intake and exhaust valves, and a closed partition wall is provided to define a first valve-operating chamber communicating with said oil tank and a second valve-operating chamber which chambers are partitioned from each other by said partition wall, wherein said cam and said cam followers are disposed in said first valve-operating chamber and said valves and said rocker arms are disposed in said second valve-operating chamber, and said rocker shafts are rotatably carried on said partition wall.

4. A valve-operating mechanism in a hand-held 4-cycle engine according to claim 3, wherein said cam is rotatably carried at an intermediate portion of said support shaft rotatably supported at its opposite ends on said engine body.

* * * * *